US005141358A

United States Patent [19]

Burke et al.

[11] Patent Number: 5,141,358

[45] Date of Patent: Aug. 25, 1992

[54] PROTECTION OF ELEVATED ROADWAYS AT EXPANSION JOINTS

[75] Inventors: Bertram V. Burke, North Plainfield; David Hall, Westfield, both of N.J.; Jay Burdett, Saratoga Springs, N.Y.

[73] Assignee: Infrastructure Protection Systems, Inc., Florham Park, N.J.

[21] Appl. No.: 653,254

[22] Filed: Feb. 11, 1991

[51] Int. Cl.[5] ..... E01C 11/02

[52] U.S. Cl. ..... 404/49; 404/68

[58] Field of Search ..... 404/47, 48, 49, 68, 404/87, 54

[56] References Cited

U.S. PATENT DOCUMENTS 580,701 4/1897 McMenamin ..... 404/54

4,699,540 10/1987 Gibbon et al. ..... 404/49

4,804,292 2/2989 DeLuca ..... 404/69

FOREIGN PATENT DOCUMENTS 1175745 12/1969 United Kingdom ..... 404/48

*Primary Examiner*—William P. Neuder

*Attorney, Agent, or Firm*—Stanger, Michaelson, Spivak & Wallace

[57] ABSTRACT

A retrofit for diverting water leaking into an elevated expansion joint is formed by lowering an applicator that carries an adhesively treated water run-off arrangement into the joint and pressing the arrangement against inside walls of the joint with an expanding bladder under fluid pressure. When the adhesive cures, reducing the pressure collapses the bladder and allows withdrawal of the applicator.

11 Claims, 3 Drawing Sheets

PROTECTION OF ELEVATED ROADWAYS AT EXPANSION JOINTS

BACKGROUND OF THE INVENTION

This invention relates to methods and means for protecting roadways from water damage at their expansion joints, and more particularly to apparatuses that install a length of a leak protecting arrangement at the joints between adjacent segments of suspended roadways.

Expansion joints for roadway sections, bridges, parking decks and the like relieve stresses caused by thermal expansion and contraction of the structures. Recently developed expansion joints not only allow for thermal expansion and contraction but also prevent rain and other roadway substances which may leak through the joints from damaging the materials of the roadway and the underlying supportive superstructure.

Such leak protective expansion joints can add years to predicted life of a roadway and save in its maintenance and repair costs.

However, most existing bridges and roadways today were built prior to the development of leak protective expansion joints. As a result, road and bridge authorities face a choice between the cost of retrofitting their bridges and roadways with run-off prevention expansion joints and the cost of repairing and maintaining such structure without such a retrofit. Existing retrofitting methods and means are comparatively complex, time consuming, and expensive.

OBJECTS AND SUMMARY OF THE INVENTION

An object of the invention is to overcome these difficulties. Another object is to improve retrofitting methods and means, and to improve retrofitted joints.

According to a feature of the invention, these objects are achieved by lowering a leak protective arrangement between adjacent paving sections at a joint and pressing the arrangement against one or both sections under fluid pressure to secure the arrangement adhesively within the joint against one or both sections.

DETAILED DESCRIPTION OF PREFERRED EMBODIMENTS

Figure 1:
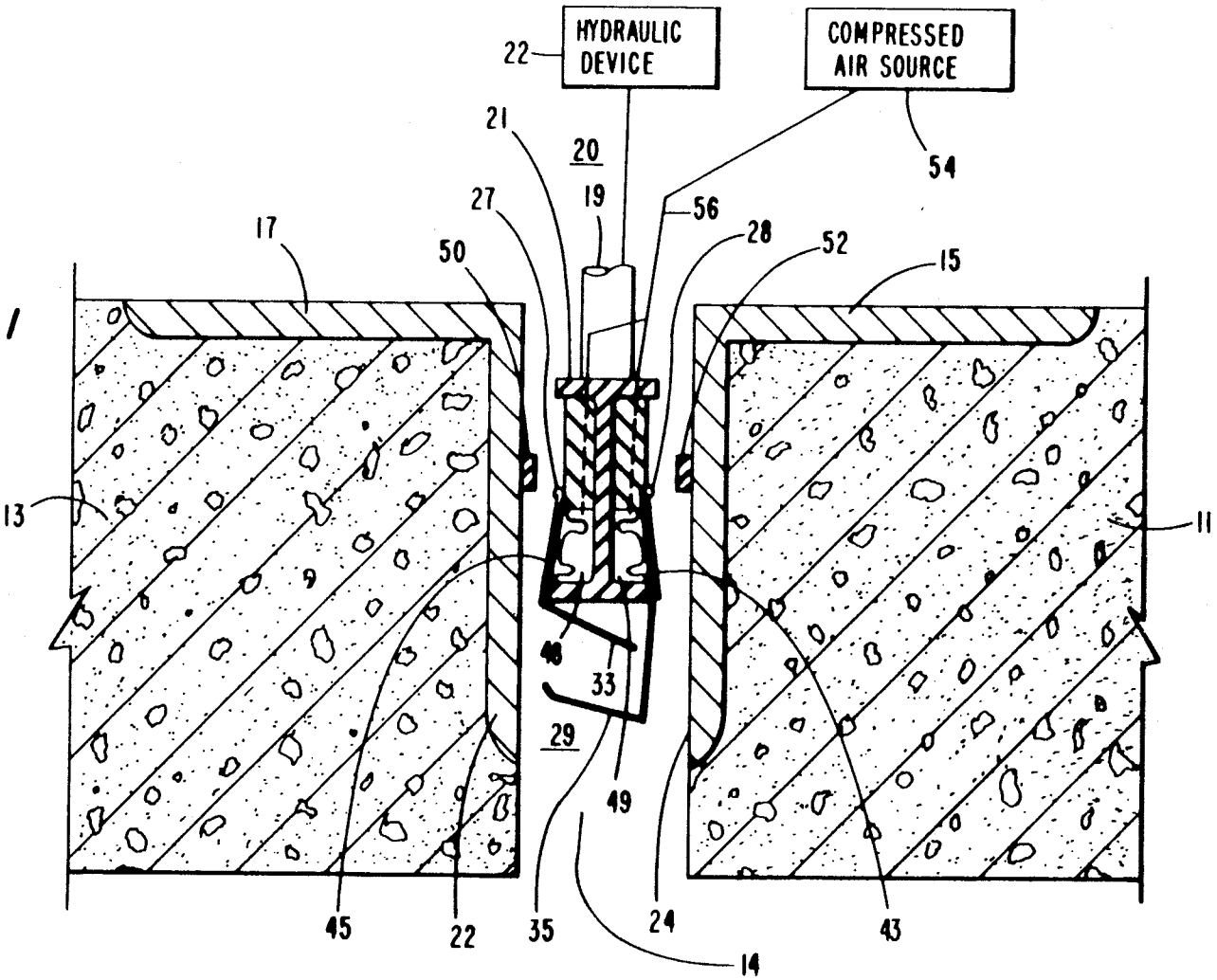
FIG. 1 shows a side cross sectional view of an apparatus in the process of applying a leak protection arrangement at the joint of two adjacent sections of roadway in accordance with an embodiment of the invention.

FIG. 1 is a cross sectional view of two adjacent concrete segments of roadway 11 and 13 at the location of an expansion joint 14. Protective armor sections 15 and 17 covering the edges of the roadway 11 and 13 prevent the underlying concrete from weathering along with the joint 14. A duct applicator generally designated 20 is placed within the joint 14. Prior to entry of the applicator 20, a cleaning apparatus (not shown) prepares the joint 14. The cleaning apparatus first cleans the roadway abutment joint 14 of any solid debris that had become stuck in the joint. Then the cleaning machine operates a rotating head that descends into the abutment joint and moves back and forth across the length of the joint 14. The rotating head of the cleaning machine removes any dirt, oil, paint or the like from the side surfaces 22 and 24 of the roadway edge armor sections 15 and 17 to expose the bare metal. This readies surfaces 22 and 24 of the edge armor sections 15 and 17 for the application of a joint.

The applicator 20 enters the abutment joint 14 between roadway segments 11 and 13. On the applicator 20 a movable shaft 19 controls a working head 21. The shaft 19 responds to a hydraulic servo, or other hydraulic device (schematical shown) 22 that is capable of dropping and lifting the working head 21 into various expansion joints.

The working head 21 of the applicator 14 descending into the abutment joint 14 includes two blocks 25 and 26 which removably hold two horizontally elongated magnetic, or spring, biasing clips 27 and 28. The latter bias a deflector plate 33 and a collector plate 35 of a run-off assembly 29 inwardly against the lower section of the head 21. The backs plates 33 and 35 bear respective resin reinforced fiber mat 43 and 45 saturated with an uncured water tight adhesive. Magnetic clips 25 and 26 on the head 21 hold the deflector plate 33 and the collector plate 35 firmly against a lower section of the working head 21. Two elongated recesses 46 and 47 in the surface of the working head 21 hold respective inflatable bladders 48 and 49. The clips 27 and 28 urge the plates 33 and 35 against the bladders 48 and 49 to cause them to cover the bladders 48 and 49 and the recesses 46 and 47.

To operate the applicator 20, the working head 21 receives a deflector plate 33 and a collector plate 35 in the biasing clips 27 and 28. The biasing clips 27 and 28 urge the plates 33 and 35 inwardly so they cover the aperture 46 and 47 and the uninflated bladders 48 and 49 within that apertures. The hydraulic device 22 now lowers the working head 21 into the joint 14 until the deflector plate 33 and the collector plate 35 are lower than two seal seats 50 and 52. The seal seats are part of the pre-existing joint to hold the joint seal.

Figure 2:
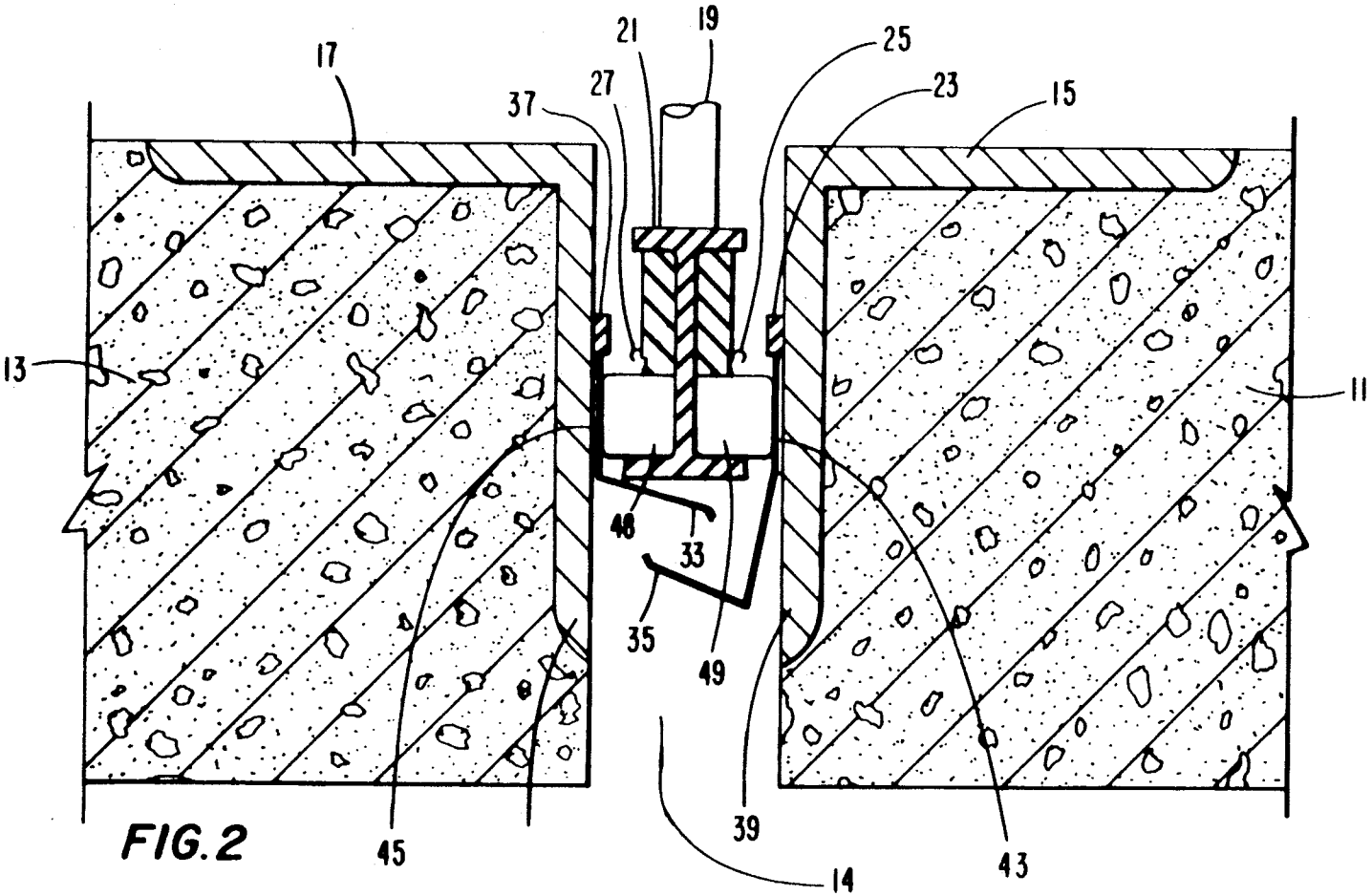
FIG. 2 shows the leak protective arrangement of FIG. 1 in place between adjacent segments of roadway.

A source 54 of compressed air now inflate bladders 48 and 49 through a suitable hose connection 56 so that the parts occupy the positions shown in FIG. 2. The inflation of the bladders 48 and 49 causes the bladders to expand beyond the recesses of the working head 21. The expanding bladders 48 and 49 press the deflector plate 33, and collector plate 35 outwardly from their positions on the working head 21. The expanding bladders 48 and 49 cause the deflector plate 33 and the collector plate 35, to separate from the bias clips 48 and 49 that held the plates 33 and 35 onto the working head 21. Once free of the spring bias clips 27 and 28 the deflector plate 33 and the collector plates 35 are forced outward by the expanding bladders 48 and 49. The outwardly moving deflector plate 33 and collector plate 35 contact the side surfaces 22 and 24 of edge armor or concrete face 15 and 17.

Once in contact, the expanded bladders 48, 49 hold the deflector plate 33 and the collector plate 35 firmly in place and press the resin reinforced fiber mats 43 and 45 behind the plates 33 and 35 against the side surfaces 21 and 24 of the edge armor faces 15 and 17. The adhesive coating the resin reinforced fiber mats 43 and 45 adheres to the side surfaces 22 and 24 of the edge armor 15 and 17. The compressed air fully inflates the bladders 29, 31 until the adhesive between the resin reinforced fiber mats 43 and 45 and the side surfaces 22 and 24 cures. Once cured, the bladders 48 and 49 are deflated to separate the contact between the head 20 and the deflector and collector plates 33 and 35. The detachment allows withdrawal of the head 20 from the joint 14. The applicator 20 is reloaded with a new length of deflector plate 33 and collector plate 35 and reinserted into a new area the joint 14 or another joint.

Figure 3:
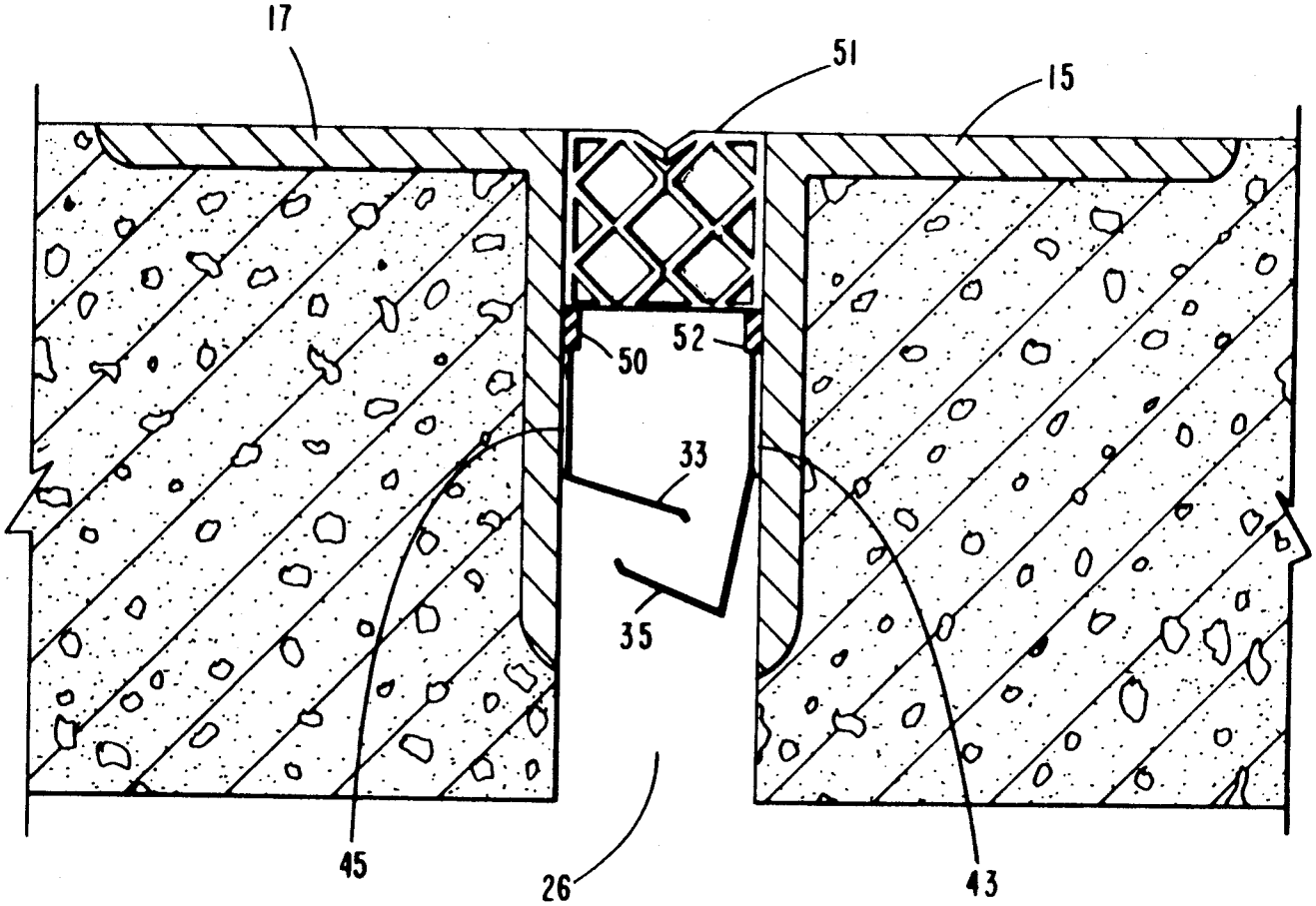
FIG. 3 shows a side cross-sectional view of a roadway abutment joint with the leak protective arrangement installed and the present invention removed.

FIG. 3 illustrates the deflector plate 33 and the collector plate 35 with the resin reinforced fiber mats 45 and 43 secured into place against the armor 22 and 24. The fiber mats 43 and 45 assure that the deflector plate 33 and the collector plate 35 adhere against the roadway edge armor. The body, thickness and compressibility of the fiber mats 45, 43 compensate for any surface irregularity that exists along the edge armor 22 and 24. The adhesive coating firmly secures the deflector plate 33 and the collector plate 35 below the seats 50 and 52 and 25 and after removal of the applicator 20, the abutment joint 14 receives a semiflexible compression seal 51 that prevents foreign material from falling into the joint 26.

The plates 33 and 35 follow the contour of the joint 14 across the roadway. They are thus pitched toward the sides of the roadway to form gutters that lead water to the edges of the roadway. The size of the applicator 20 varies for depending upon the dimensions of an joint 14 in a section of roadway. The size of the working head 21, inflatable bags 48 and 49 deflector plate 33, and collector plate 35 must fit to the space available within the abutment joint 14.

According to other embodiments of the invention, various shaped working heads make the present invention usable on odd shaped or odd angled abutment joints. The working head is in the form of I beam with insulating blocks.

According to still another embodiment, the applicator 20 holds and presses side guides 37 and 23 into place in the same manner that it installs the deflector plate 33 and the collector plate 35.

Numerous variations and modifications of the present invention exist. It should therefore be understood that the invention may be practiced otherwise than as specifically described herein.

In summary, the invention automatically installs premanufactured expansion joint run-off assemblies between existing sections of bridges, or other elevated roadways. A cleaning device first cleans the abutment between adjacent sections of roadway of debris and dirt. The hydraulic apparatus 22 then positions the applicator 20 above any joint 14 and lowers the prefabricated water run-off assembly 29 into the abutment. Once positioned, the working head 21 expands, pressing the prefabricated plates 33 and 35 against the interior walls of the abutment. The water run-off assembly attaches to the abutment walls with waterproof adhesive preapplied to the mats 43 and 45 the water run-off assembly. The water run-off assembly 29 is held into position against the walls of the roadway abutment until the adhesive cures, and the apparatus 22 withdraws the applicator 20 from the abutment. Once removed, a new length of prefabricated water run-off assembly 29 is attached to the working head of the applicator 20, and the application procedure is repeated. With the water run-off assembly 29 installed, the sealer 51 seals the abutment joint of the roadway from roadway run-off that corrodes the roadway and the underlying superstructure. Consequently the present invention allows existing bridges and other elevated roadway to be retrofitted efficiently and cost effectively, reducing the need for maintenance and future repairs.

These and other features of the invention are pointed out in the claims. Other objects and advantages of the invention will become evident from the following detailed description when read in light of the accompanying drawings.

The invention is effective because bridges and other elevated roadways are exposed to the elements more than any other structure in civil engineering. As a result, bridges and elevated roadways corrode rapidly and require a large amount of preventive maintenance and periodic repair. Bridges and elevated roadways have steel superstructures supporting their weights. These superstructures expand and contract with fluctuations in temperature throughout the year. Consequently such structures require expansion joints to be incorporated within their design. The presence of expansion joints on an elevated roadway disrupts the path of water on the surface of such roadways. Consequently, roadway water often leaks down through expansion joints and onto the superstructure in areas not designed to accept such a run-off flow. Additionally, roadway water is highly contaminated with oils, salts and acids that increase the corrosive ability of the flow on the steel superstructure. If such contaminated water continuously contacts bearing pads, rivets, cables and support members, a bridge can quickly deteriorate, become unsafe and need millions of dollars in costly repairs.

For decades, the problem of water flow through expansion joints has been an unavoidable aspect of bridge design. Even modern seals leak. Civil engineers and city planners have developed maintenance schedules for bridges with run-off corrosion as a primary consideration, and for over a century bridge corrosion from run-off has been endured. Maintenance programs for bridges and other elevated roadways have cost local governments billions of dollars. The present invention reduces the cost of maintenance of existing bridges by retrofitting them within expansion joints. Such run-off devices could be effectively retrofitted to existing bridges, so that the required maintenance for corrosion, painting, discoloration and reinforcement of existing structures could be greatly reduced.

Most existing run-off devices must be positioned between the abutment of adjacent roadways as such roadways are being formed. This traditional approach does not lend itself to retrofit applications. For such a system to be installed, the edges of each segment of roadway would have to be torn up, the run-off device installed, and the roadway edges re-laid. This process of retrofitting a roadway abutment, requires a large construction project, with a large initial outlay of capital. More importantly, such a retrofit operation would close the bridge or elevated roadway causing large traffic problems for a substantial amount of time.

The present invention provides a long awaited alternative for retrofitting existing bridges. To use the present invention the abutment between two adjacent segments of elevated roadway are cleaned of debris, dirt, and any other contaminants. The present invention them lowers a length of prefabricated run-off assembly down between the walls of the abutment. Once properly positioned, the present invention expands, pressing the run-off assembly against the walls of the abutment. The run-off assembly carries a waterproof adhesive that adheres to the wall of the abutment. Once the adhesive is cured, the applicator contracts, to disengage the run-off assembly and the hydraulic device 22 withdraws the applicator 20 from the abutment. The applicator 20 then receives a new length of run-off assembly, and the operation is be repeated at a new location.

The present invention does not require segments of the existing roadway to be torn up and replaced. Consequently, bridges and elevated roadways can be retrofitted quickly during off peak hours, and limit the effect the retrofit will have on local traffic conditions. Local governments no longer have to finance large amounts of capital for retrofit construction projects and governments will save millions of dollars on reduced maintenance, repair and replacement costs.

What is claimed is:

1. An expansion joint water run-off assembly installation apparatus for installing a run-off water deflector plate and a complimentary run-off water collector plate within the abutment joint of two adjacent segments of roadway, said installation apparatus comprising:

a working head body have a top surface and at least two opposing side surfaces, each said opposing side surface having at least one aperture formed therein;

a shaft extending upwardly from said top surface of said working head body;

a positioning means for moving said shaft up, down, back and forth within said abutment joint of two adjacent segments of roadway;

an inflatable bladder attached to said working head boy within means, spring or magnetic for temporarily holding either said run-off water collector plate or said run-off water deflector plate onto each said opposing side surface of said working head body, said deflector plate and said collector plate covering said apertures on said working head body when so held by said attachment means; and inflation means for expanding said inflatable bladders within said apertures.

2. The apparatus of claim 1 wherein said opposing side surfaces of said working head body are sloped to match the angle of said adjacent segments of roadway within said abutment joint.

3. The apparatus of claim 1 wherein said positioning means for moving said shaft is a hydraulic servo attached to said shaft, said hydraulic servo being supported by a wheeled vehicle resting upon the roadway above said abutment joint, the combination of the relative movements of said hydraulic servo and said wheeled vehicle giving said shaft the ability to move up, down and back and forth within said abutment joint.

4. The apparatus of claim 1 wherein said attachment means for temporarily holding either said run-off water deflector plate or said run-off water collector plate to said working head body is a plurality of spring clips that bias said deflector plate and said collector plate against said working head body.

5. The apparatus of claim 1 wherein said inflatable bladders, once inflated extend beyond said apertures from which said bladders are attached to said working head body.

6. The apparatus of claim 5 wherein said inflatable bladders, once inflated, contact said run-off water collector plate and said run-off water deflector plate disengaging said collector plate and said deflector plate from said attachment means.

7. The method of protecting an expansion gap of a roadway from leakage, comprising:

removably mounting a deflector arrangement having an adhesively coated portion over a fluid expandable device;

lowering the expandable device and the deflector arrangement into the gap;

pressing the adhesively coated portion of the deflector arrangement into a portion of the gap by expanding the expandable device with fluid pressure;

compacting the expandable device by decreasing the fluid pressure; and withdrawing the expandable device.

8. A method as in claim 1, wherein the step of removably mounting the deflector arrangement includes:

mounting two deflector plates, each having an adhesively coated portion, on opposite sides of the expandable device.

9. A method as in claim 1, further comprising the steps of:

removing an expandable joint inset from the gap before lowering the device into the gap; and replacing an insert into the gap after withdrawing the device.

10. An expansion joint in the walls of an expansion gap of a roadway comprising:

an expandable joint insert in the gap;

a deflector arrangement adhesively secured in a wall of the gap in the roadway;

said deflector arrangement including two overlapping portions extending substantially across the gap and adhesively secured in the walls of the gap; and one of said adhesively secured portions being an upper portion, and one said adhesively secured portions being a lower portion extending below the upper portion and forming a trough extending substantially horizontally and longitudinally along the gap.

11. A joint as in claim 10, wherein said deflector arrangement is secured to two walls of the gap.

* * * * *